United States Patent [19]

Rundquist et al.

[11] 4,344,118

[45] Aug. 10, 1982

[54] LAMP DEVICE FOR UNDERWATER USE

[75] Inventors: Hans M. Rundquist; Tore G. Sköld, both of Nyköping, Sweden

[73] Assignee: Studsvik Energiteknik AB, Nyköping, Sweden

[21] Appl. No.: 135,862

[22] Filed: Mar. 31, 1980

[30] Foreign Application Priority Data

Mar. 20, 1979 [SE] Sweden ..... 7902877

[51] Int. Cl.[3] ..... F21V 29/00

[52] U.S. Cl. ..... 362/267; 362/375

[58] Field of Search ..... 362/267, 294, 374, 375

[56] References Cited

U.S. PATENT DOCUMENTS

| | | | |
|---|---|---|---|
| 1,895,887 | 1/1933 | Lorenz | 362/294 |
| 2,709,217 | 5/1955 | McCluskey | 362/267 |
| 2,935,601 | 5/1960 | Steiner et al. | 362/267 |
| 3,086,104 | 4/1963 | Atkin | 362/375 |
| 3,265,884 | 8/1966 | Kelley, Jr. | 362/267 |
| 3,364,347 | 1/1968 | Russell | 362/267 |
| 3,474,243 | 10/1969 | Miller | 362/267 |
| 3,588,488 | 6/1971 | Lauterbach | 362/267 |
| 3,754,133 | 8/1973 | Youdin et al. | 362/267 |
| 3,864,562 | 2/1975 | Hawkins | 362/267 |
| 3,949,212 | 4/1976 | Larrimore | 362/267 |
| 3,955,076 | 5/1976 | Shaw | 362/183 |
| 4,259,710 | 3/1981 | Schlack | 362/267 |

*Primary Examiner*—Donald P. Walsh

*Attorney, Agent, or Firm*—Burns, Doane, Swecker & Mathis

[57] ABSTRACT

A lamp device for underwater use comprises a sealed beam lamp (1, 3, 5) mounted in a casing (7) designed as a pressure vessel, so that the lens part (1) of the sealed beam lamp constitutes part of the pressure vessel wall in the form of a pressure vessel lid and so that the back side (5) of the sealed beam lamp having the electrical connecting means of the sealed beam lamp is within a water-tight pressure chamber. The pressure vessel casing bears against the back side of the circumferential flange (3) of the sealed beam lamp, a ring sealing means (23) placed in a groove in the casing being arranged therebetween. The flange (3) is applied against the casing (7) by means of a ring plate (19) bearing against the front side of the flange via a pressure balancing packing (27), the ring plate being releasably tightened to the casing. The pressure chamber has such dimensions that a considerable free space is obtained around the back side (5) of the sealed beam lamp, so that thermal self-convection transferring generated lamp heat to the water-cooled walls of the casing is obtained. According to a preferred embodiment, connection leads (28, 29) brought through the pressure vessel wall in a pressure and water-tight manner, are drawn along the inner side of the wall to a connector (31) from where heat-resistant leads (37, 39) are drawn to the electrical connecting means of the sealed beam lamp.

The lamp device means that the weak side of the sealed beam lamp is completely protected, that a very good cooling is obtained without any particular cooling arrangement, such as cooling flanges, and that both the sealed beam lamp and connecting leads can be replaced easily.

In a particular deep water embodiment, a pressure absorbing chamber filled with a liquid is arranged in front of the lens part of the sealed beam lamp.

7 Claims, 5 Drawing Figures

LAMP DEVICE FOR UNDERWATER USE

TECHNICAL FIELD

The present invention relates to a lamp device for underwater use comprising a lamp unit arranged in a casing so that the lamp, reflector and electrical connecting means of the lamp unit are water tightly enclosed. More particularly, the invention relates to a lamp device of the above-mentioned kind which is intended for being able to be used at a great water depth, in an ordinary design down to a depth of at least 60 meters and in a special design down to a depth of at least some hundreds of meters, and with a very high lamp power, typically 1000 W, and which despite the usefulness at great depth and the high lamp power is not clumsy or unhandy, but is easily moveable and possible to use as a "handlamp" also under hard working conditions and, moreover, makes an easy lamp replacement possible.

PRIOR ART

From CH-PS 542401 there is previously known a lamp device primarily intended to be used in spaces where an explosion risk exists and/or in whet spaces. The lamp device which is intended to be supplied with a mains voltage of 220 V for feeding a low voltage lamp via a transformer, comprises a casing having two chambers, one chamber being closed by means of a lid and being intended for receiving a mains connecting cable and the other chamber containing the transformer and having an opening wherein a lamp unit is mounted. The lamp unit includes a reflector having a low voltage lamp arranged therein and a thick flat glass plate closing said opening. The circumferential edge flange of the reflector abuts against a spacer ring positioned at the opening of the casing and connected thereto and is pressed against the spacer ring by the glass plate via a flat sealing arranged between the boarder area of the glass plate and the edge flange of the reflector. The glass plate in its turn is kept in position by means of an outer mounting ring being screwed to the casing around said operating. The outer diameter of the glass plate is adapted to the diameter of the opening of the casing in order to provide a certain gas seal of the second chamber together with the previously mentioned flat sealing.

Furthermore, in the patent specification there is stated that the lamp device disclosed also can be designed so as to be watertight at water pressures which are not too high. For this purpose, according to the patent specification, the previously mentioned glass plate has to be brought into watertight connection to the casing of the lamp device. However, in the patent specification there is no directive as to how this water seal, which thus has to be accomplished between the circumferential peripheral edge surface of the glass plate and the casing wall connecting thereto, could be made. In the patent specification there is, however, stated, that specific means also have to be arranged for smoothing out air expansion caused by heat in the second chamber, so that water is not sucked in after cooling of the lamp device. This makes it clear that it has been realized that a good seal against penetration of water can not be provided quite simply.

Consequently, the patent specification does not give any functional solution of the problem of providing a lamp device which can be used at great water depth. Moreover, the presence of a transformer within the lamp device means that a high lamp power the lamp device will be both very heavy and very voluminous and thus not possible to use as a "handlamp".

Low power lamp devices intended for stationary use under water under less demanding conditions, such as in swimming pools, are also commonly known. When using conventionally designed lamp units, lamp devices of this kind include a water tight bowl-shaped casing which is intended to be placed in a corresponding recess of the wall of the swimming pool and which contains a lamp and a reflector, the opening of the casing facing outwardly being intended to be sealingly closed by an outer lens or glass plate tightened by screws or firmly mounted in some other way. The lens or glass plate is strongly built and has a circumferential boarder area which is brought into a tight engagement with the casing via a gasket. Due to the fact that the glass plate is strongly built and thus can stand relatively great stresses when mounted and has machined boarder area surfaces which can cooperate with a particularly designed gasket enclosing the boarder area, the required seal can be obtained without any greater difficulties at the small water depth in question in this case. An example of a lamp device of this kind which, however, is not suitable for the field of application mentioned in the introductory part, is disclosed in U.S. Pat. No. 2,935,601.

It is also known in connection with low power lamp devices for stationary use in swimming pools and the like to use a lamp unit in the form of a so called sealed beam lamp, wherein the sealed beam lamp is inserted in a casing in such a way that at least the part of the back side of the sealed beam lamp including the electrical connecting means of the lamp is watertightly enclosed.

A lamp device of this kind is previously known from U.S. Pat. No. 3,265,884. In this known lamp device the sealed beam lamp is mounted by being pressed against a mounting ring from behind, wherein the front side of the annular flange of the sealed beam lamp bears against the mounting ring, the mounting ring in its turn being attached to an annular plate tightened by screws to the circumferential edge of the casing. The pressing of the sealed beam lamp against the mounting ring is accomplished by means of clamp rods extending backwards from the mounting ring, the clamp rods at the back acting on a smaller sealing cone via a clamp plate, thus forcing the sealing cone against the rearmost part of the backside of the sealed beam lamp. This part of the back side of the sealed beam lamp has a good surface smoothness and thereby permits a good sealing contact, so that the electrical connecting means of the sealed beam lamp are tightly enclosed within the sealing cone. The intention of such an arrangement is to achieve that the space which has to be water tight will be as small as possible.

Another lamp device of this kind is previously known from U.S. Pat. No. 3,955,076. In this device, when mounted the smooth backside of the sealed beam lamp is pressed against a sealing means arranged at a sealing bowl provided within the casing of the lamp device, so that the electrical connecting means of the sealed beam lamp are enclosed in a water proof condition. Said pressing is accomplished by means of a mounting ring bearing against the front side of the annular flange of the sealed beam lamp, the mounting ring being attached to the casing of the lamp device.

In these known lamp devices the back side of the sealed beam lamp, being the weak side and unable to withstand high pressures, is not completely protected.

Consequently, the lamp devices cannot be used at great water depth, where the pressure essentially exceeds the pressure at which sealed beam lamps implode, due to a pressure load on the back side.

Also, these known lamp devices are not possible to use at very great lamp powers due the great risk of an overheating of the back side of the sealed beam lamp with a detrimental influence both on the electrical connecting means and wires and on the sealing means bearing against the back side.

SUMMARY OF THE INVENTION

The lamp device according to the invention comprises a lamp unit in the form of a sealed beam lamp and a casing designed in the form of a pressure vessel, wherein the sealed beam lamp is arranged in an opening of the casing so that the lens part of the sealed beam lamp constitutes a part of the pressure vessel wall in the form of a pressure vessel lid and so that the back side of the sealed beam lamp and thereby the electrical connecting means of the lamp are in a water tight pressure chamber. The contact between the casing and the sealed beam lamp at the opening of the casing occurs at the back side and/or the rear peripheral corner of the circumferential flange of the sealed beam lamp via an intermediate sealing means. The sealing means has the form of a ring sealing means provided in a groove of the casing, the ring sealing means being designed so that a seal is obtained at the unmachined rough back side of the annular flange and/or the rear corner thereof and so that a balancing or compensating of the pressure strains on said parts of the annular flange and a spacing of the annular flange from the casing are obtained simultaneously. The firm setting of the annular flange of the sealed beam lamp is obtained by a ring means bearing against the front side of the annular flange of the sealed beam lamp via a pressure balancing packing and being releasably attached to the pressure vessel casing. Due to the fact that the sealed beam lamp in this way is arrange to constitute a pressure vessel lid which can be removed easily, an extremely easy access to the connecting details contained in the pressure chamber which has the function of a connection space, is made possible. At the same time an extremely easy replacement of the sealed beam lamp itself, of course, is made possible.

The ring sealing means, thus being arranged in a groove in the casing, the groove suitably being located in a flange portion of the casing surrounding the opening of the casing, fills the groove at least for the main part (preferably also when unloaded) and has a part which is not negligible, located outside the real groove, so that the sealing means cannot be pushed into the pressure chamber when pressure loaded, due to increasing water depth, and so that the increasing setting or pressing of the annular flange of the sealed beam lamp obtained at an increasing water depth, cannot lead to a direct contact between the annular flange and the casing. Suitably, the ring sealing means is made of a material having such a flexibility that an increasing setting of the annular flange of the sealed beam lamp will provide an increasing contact surface between the ring sealing means and the annular flange so that the strains of the annular flange are distributed further and a breakage of the annular flange is prevented. Of course, in itself the abovementioned increasing pressing means that the sealing effect is improved just when needed. Consequently, the setting pressure of the annular flange can be kept low when mounting the lamp device, whereby strains imposed on the annular flange at heavily increasing water pressure tending to press the sealed glass lamp more firmly against the casing, safely can be kept at a level acceptable to the annular flange of the lamp.

It has been found important that one of the cooperating surfaces of the annular flange of the sealed beam lamp and the ring sealing means is rounded and the other is substantially flat, at least when unloaded. This makes possible a winding contact or sealing path around the sealed beam lamp which, in combination with the flexibility of the ring sealing means, implies that the roughness of the contact surface of the annular flange can be compensated for. According to the invention, this can be accomplished particularly advantageously in two different ways. According to the first way, the upper part of the ring sealing means is rounded, the ring sealing means preferably being a so-called O-ring, and is intended to cooperate with the generally flat back side of the annular flange. According to the second way, the rear outer rounded corner of the annular flange is used for cooperation with a ring sealing surface being inclined or oblique relative to the plane of the annular flange. The ring sealing surface can be considered substantially flat, although it has a certain curvature because it has the shape of an envelope surface of a truncated cone. This surface also could be slightly curved (preferably concavely curved) as seen in a crossection. According to this second way, the ring sealing means can have a generally triangular cross-section.

It has thus been found, that the use according to the invention of a ring sealing means of the particular kind described above in combination with the front flange packing enables a safe seal also at a great water depth without any risk of imposing any harmful stresses on the relatively fragile annular flange of the sealed beam lamp. The excellent seal obtained also at a great depth means a great safety against penetration of water into the pressure chamber. This means that very heavy requirements as to electrical security are fulfilled which in its turn makes it possible to use a high supply voltage. Thus, in a device according to the invention the sealed beam lamp can be supplied with a voltage of 110 or 220 V, for example. This means that even at a lamp power as high as 1000 W, there is no need for a supply cable being so heavy that the lamp device will be unhandy.

The casing, preferably being bowl-shaped, has such dimensions that a substantial free space is obtained around the back side of the sealed beam lamp within the pressure chamber, so that thermal self-convection is provided within the chamber. Combined with the direct cooling of the pressure vessel wall obtained due to the surrounding water, this means that there is no risk of over-heating within the pressure chamber.

Inside the pressure chamber the connecting leads which are brought through the wall of the pressure casing into the pressure chamber in a pressure and watertight manner, to the extent possible are passed along the pressure chamber wall in order to obtain a good cooling effect. According to a preferred embodiment of the invention the in-coming leads are drawn to a connector arranged at the pressure chamber wall, specific heat-resistant leads being arranged between the connector and the electrical connecting means of the sealed beam lamp. These high temperature resistant leads can, for instance, consist of wires insulated by silicon rubber and covered by glass fibers. To advantage, the connector can be located in the front part of the pressure casing, that is, so that the high temperature resistant leads extend rearwardly to the connecting means of the sealed beam lamp within the pressure chamber, whereby the sealed beam lamp easily can be removed from the pressure casing while bending said leads forward, the connection between the leads and the sealed beam lamp only then being released easily.

Suitably, a transparent protective plate or the like can be arranged in front of and spaced from the lens part of the sealed beam lamp. This plate can be attached to the ring means mentioned previously and pressing the flange of the sealed beam lamp against the pressure casing, spacer means being arranged therebetween.

According to an embodiment of the invention according to the invention intended to be possible for use at very great water depths, a pressure absorbing chamber is arranged in front of the lens part of the sealed beam lamp. In this case, the front wall of the chamber can consist of a transparent plate or lens, preferably outwardly convex, and the rear wall can consist of the lens part of the sealed beam lamp. The chamber is filled with a fluid, preferably a liquid, such as distilled water, enabling a good heat transfer from the lens part to the surroundings. If the fluid is not compressible per se, a compressible means, for instance a hollow body having a certain flexibility or a body of compressible cellular material, is arranged within the chamber. Due to this arrangement pressure variations resulting from temperature variations and depth variations can be balanced or compensated. Suitably, the side wall of the pressure absorbing chamber can be pressure-tightly secured to the casing or casing flange of the lamp device.

In the following the invention will be described more closely by embodiments while referring to the accompanying drawing

DESCRIPTION OF THE PREFERRED EMBODIMENTS

Figure 1:
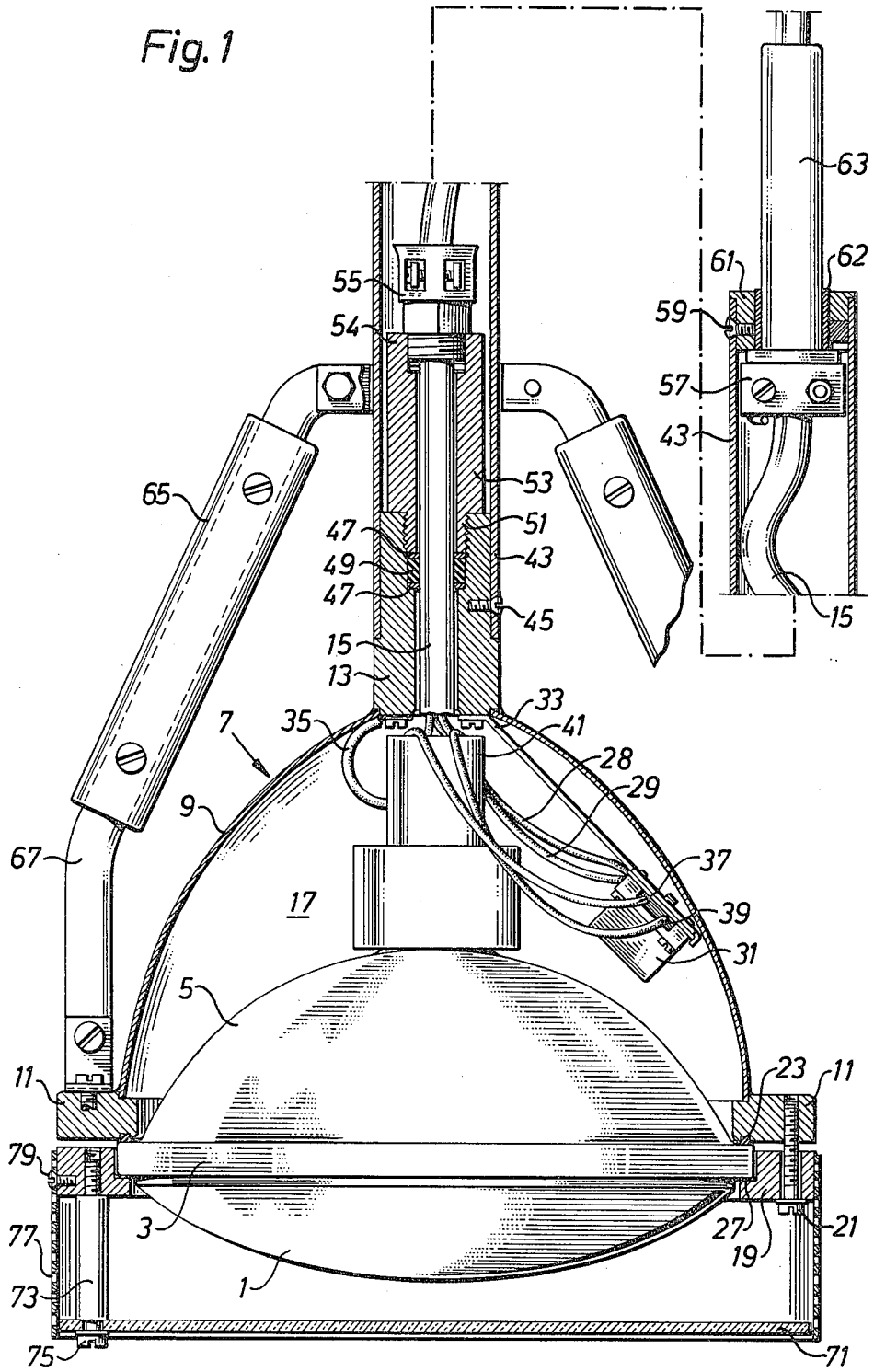
FIG. 1 is a schematic elevation view, partly in section, of a lamp device according to the invention.

The lamp device shown in FIG. 1 comprises, as main parts, an integral sealed beam lamp consisting of a front side or lens part 1, an annular flange 3 and a back side or reflector 5; a pressure vessel casing 7 consisting of a bowl-shaped steel sheet jacket 9, an annular jacket flange 11 welded to the front edge of the jacket, and a metal sleeve 13 welded to the rearmost part of the jacket and extending axially rearwards, a connection cable 15 being introduced through the metal sleeve in a pressure and water-tight manner into the pressure chamber 17 formed by the back side of the sealed beam lamp and the pressure vessel casing; a ring plate 19 having a step adapted to the front side and the lateral surface of annular flange 3 for pressing the back side of flange 3 against jacket flange 11, screws 21 being arranged for tightening ring plate 19 to jacket flange 11; a sealing O-ring 23 arranged in a groove in jacket flange 11 for cooperation with the back side of flange 3; and a flat packing 27 arranged between the front side of flange 3 and ring plate 19, the packing being located on the step of the ring plate.

The insulated current supply wires 28, 29 of connection cable 15 directly after leaving sleeve 13 are drawn closely along the inner side of jacket 9 to a connector 31. The connector also is located close to the inner side of jacket 9 and is fixed on one end of a holder 33, the other end of which is screwed to sleeve 13. Connector 31 is located in the front part of pressure chamber 17, in the example shown somewhat more than halfway from sleeve 13 to jacket flange 11. The ground wire 35 of connection cable 15 is screwed to sleeve 13.

From connector 31 there are drawn insulated high-temperature resistant current supply leads 37, 39 to a terminal means 41 which is arranged releasably on electrical contacts (not shown) projecting from the back side of the sealed beam lamp. Leads 37, 39 have such a length that after being loosened the sealed beam lamp can be withdrawn enough for enabling easy removal of terminal means 41 and/or disconnection of leads 37, 39 from connector 31.

On the rear part of sleeve 13 which part has a reduced diameter, a tubular handle 43 is attached releasably by means of screws 45, the handle containing cable bushings and strain reliefs. The through-hole of sleeve 13 at its front part has a diameter that is somewhat larger than the diameter of connection cable 15. At the rear part of sleeve 13 the diameter of the through-hole is increased in order to provide a conventional pressure and water-tight gasket. Thus, in the front portion of the hole part having an increased diameter there is a combination of two annular washers 47 and an intermediate compression packing gland 49 on cable 15, said combination being tightened by means of a sleeve screw 51 threaded on the outside and screwed into the rear threaded portion of the hole part having an increased diameter. The sleeve screw has an externally hexagonal sleeve head 53 that is axially elongated and bears against the rear end of sleeve 13. At the rear end 54 of sleeve head 53, a conventional strain relief 55 for cable 15 passing through the sleeve head is threadedly fastened.

At the rear end of handle tube 43, a second strain relief 57 is arranged freely on cable 15 in front of a handle terminal means 61 fixed by screws 59. The cable passing through an insulating sleeve 62 being part of the handle terminal means, is provided with a protective shield 63 against bending stresses.

It should be realized that the double strain relief in accordance with the invention makes it possible to attach cable 15 in such a way that after leads 28, 29 once have been given a correct passage within the pressure chamber and the first strain relief 55 has been assembled and handle tube 43 has been put into position, the finalizing assembling at the rear end of handle tube 43 cannot affect the positions of leads 28, 29 adversely.

On either side of the lamp device, a strut element 67 having a hand grip 65 is attached between the back side of jacket flange 11 and handle tube 43.

In front of lens part 1 of the sealed beam lamp there is provided a circular transparent protective plate 71. The plate is spaced from the lens part by means of bolts 75 provided with spacer sleeves 73, the bolts being screwed to ring plate 19. A circumferential side protective shield 77 is also attached to the ring plate by screws 79. Side protective shield 77 is perforated so as to allow surrounding water to flow past lens part 1 for cooling thereof.

Figure 2:
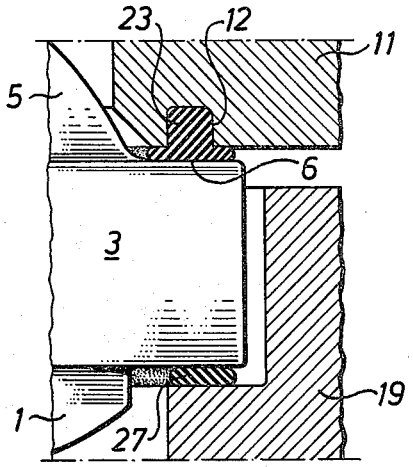
FIG. 2 is a partial view on a larger scale illustrating the seal between the annular flange of the sealed beam lamp and the casing.

The arrangement of sealing O-ring 23 is shown in more detail in FIG. 2. The arrangement is not made in a conventional manner with regard to flange joints, because O-ring 23 fills mounting groove 12 on the whole already when in an unloaded state. The dimensions of groove 12 are such that an essential part of the O-ring, preferably of the order of $\frac{1}{3}$, is located outside the groove, whereby back side 6 of annular flange 3 of the sealed beam lamp will ride flexibly on O-ring 23 spaced from the surfaces of jacket flange 11 surrounding groove 12, also in a loaded state. Thus, in a loaded state, the O-ring will have a substantially T- or mushroom-shaped cross-section, the contact surface against back side 6 of annular flange 3 thus increasing at increasing pressing force thereby distributing the stresses imposed on the annular flange over an increasing surface. At the initial contact between the rounded projecting flexible part of the O-ring and the back side of the annular flange that is unmachined and rough, a good seal can be obtained already at a very low setting pressure. Consequently, when assembling the lamp device screws 21 have to be tightened only slightly (which suitably is done by means of a dynamometric wrench), for what reason the risk of tightening damages is completely removed both at the front side and at the back side.

Typically, O-ring 23 can be made of chloroprene rubber or the like.

Figure 3:
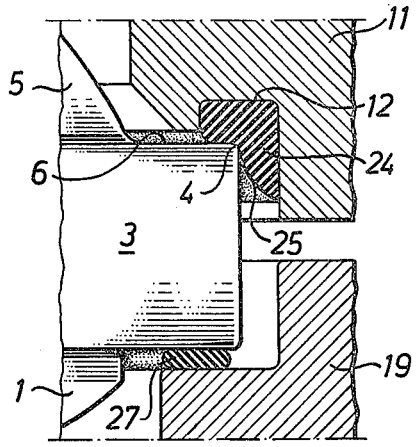
FIG. 3 is a view of the same kind as in FIG. 2, but with an alternative design of the ring sealing means.

In FIG. 3 there is shown an alternative accomplishment of the seal between annular flange 3 of the sealed beam lamp and jacket flange 11. Ring sealing means 24, which is arranged in groove 12, has a generally triangular cross-section and an oblique or inclined sealing surface for cooperation with rear corner 4 of annular flange 3. In this case, the seal is provided round corner 4 and at the part of back side 6 of the annular flange which connects to the corner. At an increasing setting pressure the stresses imposed on annular flange 3 will be distributed over a larger surface on back side 6 of the annular flange.

Figure 4:
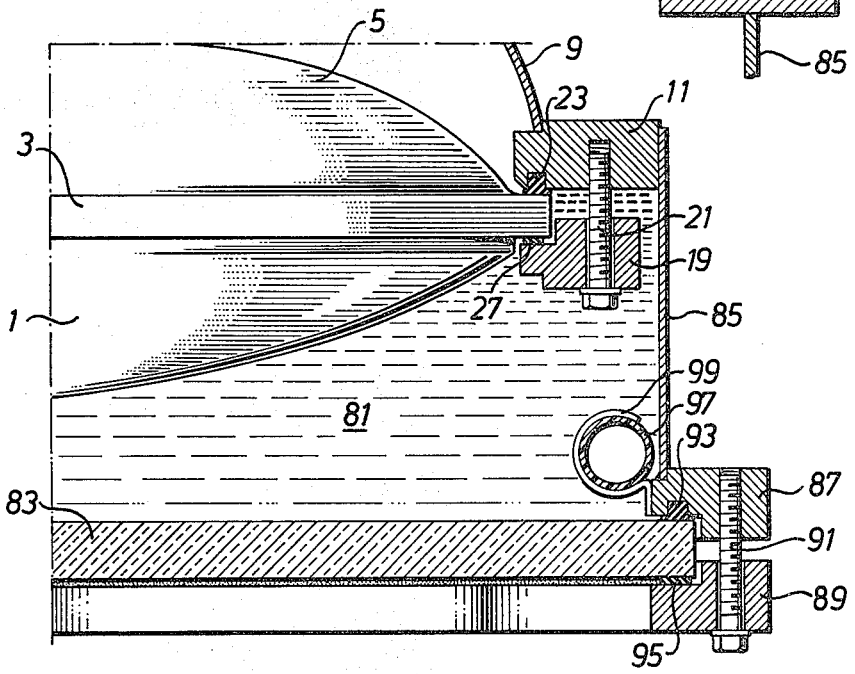
FIG. 4 is a schematic partial view, partly in section, of a modified lamp device of FIG. 1, wherein the modified lamp device is provided with a pressure absorbing chamber filled with a liquid and protecting the lens part of the sealed beam lamp.

In the modified embodiment of the lamp device according to the invention shown in FIG. 4 a pressure absorbing chamber 81 filled with distilled water is arranged in front of lens part 1 of the sealed beam lamp. The chamber is defined by lens part 1, a more heavily constructed transparent plate 83 and a circumferential side wall 85 made of steel sheet. The side wall is welded on one hand at the outer side of jacket flange 11 (which in this embodiment does not have any holes passing therethrough, but is completely pressure-tight), and on the other hand at the rear inner edge of a second ring plate 87. The rear edge part of plate 83 is pressed sealingly against the front inner part of ring plate 87 by means of a third ring plate 89, the rear inner part of which bears against the front edge part of plate 83 and which is tightened to ring plate 87 by means of bolts 91. A sealing O-ring 93 is arranged between plate 83 and ring plate 87, the O-ring being in a groove in the latter plate. A flat packing 95 is arranged between plate 83 and ring plate 89. Sealing O-ring 93 suitably is designed and arranged in the same way as sealing O-ring 23 (FIG. 2). However, it can provide a seal at substantially higher pressure because plate 83 has a smoother contact surface and can withstand higher engagement pressure.

Inside chamber 81 there is arranged a compressible means in the form of a closed hollow air-filled rubber or plastic hose. The hose extends around chamber 81 and is attached to ring plate 87 by means of clamps 99.

For filling water into chamber 81, a closable opening can be provided in side wall 85. An example of how this can be arranged is shown in FIG. 5, in which 101 is a bushing having a hole with a reduced diameter at the inner end thereof; 103, 105 are a compression sealing means consisting of two round washers and an intermediate cylindrical sealing body; and 107 is a screw intended to be threaded into the hole of bushing 101 for tightening the compression sealing means.

Figure 5:
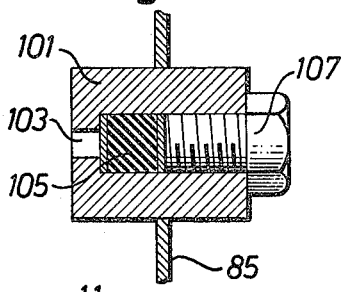
FIG. 5 is a schematic partial sectional view of a means enabling liquid to be filled into the pressure absorbing chamber.

The embodiment of FIGS. 4 and 5 makes it possible to use the lamp device at very great depths. The construction is such that at a greatest permissible external pressure, for instance corresponding to a water depth of 200–300 meters, the pressure inside of chamber 81 will not exceed the pressure which corresponds to the maximum water depth permitted for the lamp device according to the embodiment of FIG. 1.

We claim:

1. A lamp assembly for underwater use, comprising:

a sealed beam lamp including a front lens, a back side, and a flange surrounding the adjacent edges of said lens and back side;

said flange including a front surface and a rear surface, a casing disposed over said back side of said sealed lamp and forming therewith a water-tight pressure chamber, said casing including a groove facing said rear surface of said flange, a sealing ring disposed in said groove in sealing relationship with said casing and said rear surface of said flange to seal said chamber, a pressing ring forming a gap with said casing and including a portion facing said front surface of said flange, a pressure balancing packing interposed between said portion of said pressing ring and said front surface of said flange, and means for releasably interconnecting and drawing together said pressing ring and said casing such that said pressing ring presses said flange against said seal ring, and electrical connecting means disposed in said chamber and connected to said sealed lamp.

2. A lamp assembly as claimed in claim 1, wherein said seal ring is disposed in a groove in a flat face of said casing, said seal ring sized larger than the groove such that the ring is compressed against said flat face and said rear surface of said flange and assumes a T-shaped cross-section.

3. A lamp assembly as claimed in claim 1, wherein said seal ring is arranged to contact a corner of said flange.

4. A lamp assembly as claimed in claim 1, wherein said electrical connecting means comprises connection leads extending into said chamber, a connector disposed within said chamber at a wall thereof, said connection leads extending along the wall and being coupled to said connector, and heat resistant leads coupled to said connector and said sealed beam lamp.

5. A lamp assembly as claimed in claim 1, wherein a pressure absorbing chamber is arranged in front of said lens and includes a front transport wall extending across said lens in spaced relation therewith, and side walls connected to said casing in a fluid-tight manner, said pressure absorbing chamber being filled with a fluid.

6. A lamp assembly as claimed in claim 5, including a compressible member disposed in said pressure absorbing chamber, to be compressed by said fluid as the pressure thereof increases.

7. A lamp assembly as claimed in claim 5, wherein said fluid is a liquid.

* * * * *